US011022032B2

(12) United States Patent
Kontani et al.

(10) Patent No.: US 11,022,032 B2
(45) Date of Patent: Jun. 1, 2021

(54) ENGINE

(71) Applicant: HONDA MOTOR CO., LTD., Tokyo (JP)

(72) Inventors: Masahiro Kontani, Wako (JP); Kensuke Mori, Wako (JP); Toshiaki Deguchi, Wako (JP); Shinichi Kurita, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/516,524

(22) Filed: Jul. 19, 2019

(65) Prior Publication Data

US 2020/0063654 A1 Feb. 27, 2020

(30) Foreign Application Priority Data

Aug. 24, 2018 (JP) ..... JP2018-157192

(51) Int. Cl.
*F02D 11/10* (2006.01)
*F02B 61/02* (2006.01)
(Continued)

(52) U.S. Cl.
CPC ..... *F02B 61/02* (2013.01); *F02B 75/18* (2013.01); *F02F 1/4214* (2013.01); *F02B 2075/1816* (2013.01); *F02F 2001/245* (2013.01)

(58) Field of Classification Search
CPC ... F01L 1/022; F01L 1/026; F01L 2001/0537; F01L 2250/04; F01L 2810/00;
(Continued)

(56) References Cited

U.S. PATENT DOCUMENTS 6,832,590 B2 12/2004 Hattori et al.
2005/0133004 A1* 6/2005 Maehara ..... F02D 9/1065 123/336
(Continued)

FOREIGN PATENT DOCUMENTS

DE 102014211605 A1 3/2015
EP 2599984 A2 6/2013
(Continued)

OTHER PUBLICATIONS

German Office Action for German Application No. 102019211527.6, dated Mar. 3, 2020, with English translation.
(Continued)

*Primary Examiner* — George C Jin
*Assistant Examiner* — Teuta B Holbrook
(74) *Attorney, Agent, or Firm* — Birch, Stewart, Kolasch & Birch LLP

(57) ABSTRACT

An engine includes: a cylinder head that forms an intake port connected to a combustion chamber; a throttle body that is joined to the intake port and adjusts a degree of an opening of an intake passage by rotating a throttle vale around a rotation axis of a valve shaft, the throttle vale being fixed to the valve shaft; and a case that stores a drive member and supports a drive motor, the drive member being fixed to the valve shaft, the drive motor generating a drive force that is transmitted to the drive member. The case overlaps with the intake port as seen in a side view. Accordingly, in the engine, it is possible to reduce the volume of the intake passage between the throttle valve and the combustion chamber.

15 Claims, 5 Drawing Sheets

(51) Int. Cl.
*F02F 1/42* (2006.01)
*F02B 75/18* (2006.01)
*F02F 1/24* (2006.01)

(58) Field of Classification Search
CPC ..... F02B 61/02; F02B 75/20; F02D 11/10; F02D 2700/0243; F02D 9/1065; F02D 9/107; F02D 9/1095; F02M 35/10177; F02M 35/162
See application file for complete search history.

(56) References Cited

U.S. PATENT DOCUMENTS

2006/0011168 A1* 1/2006 Hanasato ..... F02D 9/1065 123/399
2006/0042589 A1 3/2006 Hanasato
2009/0314231 A1* 12/2009 Kontani ..... F02B 75/22 123/54.4
2010/0050976 A1* 3/2010 Taki ..... F02F 7/0058 123/195 C
2011/0155083 A1* 6/2011 Sato ..... F02B 75/22 123/54.4
2013/0133617 A1* 5/2013 Machida ..... F02D 9/109 123/336
2015/0083078 A1* 3/2015 Kontani ..... F02D 9/1065 123/337

FOREIGN PATENT DOCUMENTS

JP 2010019137 A * 1/2010 ..... F02D 9/105
JP 2011-132909 A 7/2011
JP 2011-149278 A 8/2011
JP 2012207544 A * 10/2012
JP 5357002 B2 * 12/2013 ..... F02D 11/10
JP 2017-194052 A 10/2017
WO WO 01/95091 A1 9/2001

OTHER PUBLICATIONS

German Search Report for German Application No. 102019211527.6, dated Mar. 3, 2020, with English translation.
Indian Examination Report for Indian Application No. 201944033042, dated Mar. 25, 2021, with an English translation.

* cited by examiner

ENGINE

BACKGROUND OF THE INVENTION

Field of the Invention

The present invention relates to an engine, including: a cylinder head that forms an intake port continuing to a combustion chamber; a throttle body that is joined to the intake port, and that adjusts a degree of an opening of an intake passage by rotating a throttle vale around a rotation axis of a valve shaft, the throttle vale being fixed to the valve shaft; and a case that stores a drive member and supports a drive motor, the drive member being fixed to the valve shaft, the drive motor generating a drive force that is transmitted to the drive member.

Description of the Related Art

Japanese Patent Application Laid-open No. 2017-194052 discloses a throttle body supporting a throttle valve that rotates around the axis of a valve shaft according to the drive force of an electric motor. The throttle valve adjusts the opening area of the intake passage. Between the throttle valve and the combustion chamber, a pressure sensor detecting pressure of the intake passage is disposed.

In Japanese Patent Application Laid-open No. 2017-194052, although it is suggested that increase of the engine output and improvement of the combustion stability in low load operation are achieved when the volume of the intake passage is reduced between the throttle valve and the combustion chamber, even when reduction of the volume of the intake passage is hard between the throttle valve and the combustion chamber, by adjusting the degree of opening of the throttle valve according to the pressure of the intake passage, both of increase of the engine output and the combustion stability in low load operation are achieved. An art for reducing the volume of the intake passage between the throttle valve and the combustion chamber has not been disclosed in concrete terms.

SUMMARY OF THE INVENTION

The present invention has been achieved under the circumstance described above, and its object is to provide an engine capable of reducing the volume of the intake passage between the throttle valve and the combustion chamber.

In order to achieve the object, according to a first aspect of the present invention, there is provided an engine, comprising: a cylinder head that forms an intake port connected to a combustion chamber; a throttle body that is joined to the intake port and adjusts a degree of an opening of an intake passage by rotating a throttle vale around a rotation axis of a valve shaft, the throttle vale being fixed to the valve shaft; and a case that stores a drive member and supports a drive motor, the drive member being fixed to the valve shaft, the drive motor generating a drive force that is transmitted to the drive member, wherein the case overlaps with the intake port as seen in a side view.

With the first aspect, in operation of the throttle valve, the drive member is displaced around the rotation axis of the valve shaft. The case has an extent that does not interfere with the drive member at the time of displacement of the drive member. Meanwhile, since the case overlaps with the intake port as seen in a side view, the throttle valve can approach the intake port as much as possible. Thus, the volume of the intake passage can be reduced from the downstream of the throttle valve to the combustion chamber. As a result, the intake efficiency improves.

According to a second aspect of the present invention, in addition to the first aspect, there is provided the engine, further comprising: a first gear that is attached to a first shaft, engages with the drive member, rotates around an axis of the first shaft, and drives the valve shaft; and a second gear that is attached to a second shaft, engages with the first gear and the drive motor, rotates around an axis of the second shaft, and transmits a drive force from the drive motor to the first gear.

With the second aspect, the first gear of the first shaft and the second gear of the second shaft configure a deceleration mechanism between the drive member and the drive motor. Since the deceleration mechanism is disposed between the drive member and the drive motor, the drive motor can get away from the intake port. As a result, interference of the drive motor and the intake port can be avoided.

According to a third aspect of the present invention, in addition to the second aspect, a drive shaft of the drive motor is positioned on a cylinder head side of an imaginary plane that includes an outer end of the intake port.

With the third aspect, since the drive motor is disposed at a position close to the cylinder head, the engine can be formed compact. Also, since the drive motor is disposed in a dead space around the cylinder head, the space around the cylinder head can be utilized efficiently.

According to a fourth aspect of the present invention, in addition to the third aspect, the second gear is positioned at least partially on the cylinder head side of the imaginary plane including the outer end.

With the fourth aspect, since the second gear of the deceleration mechanism is disposed at a position close to the cylinder head, the drive motor can get access to the cylinder head more closely, and the engine can be formed more compact.

According to a fifth aspect of the present invention, in addition to the fourth aspect, the first gear is positioned at least partially on the cylinder head side of the imaginary plane including the outer end.

With the fifth aspect, since the first gear of the deceleration mechanism is disposed at a position close to the cylinder head, the drive motor can get access to the cylinder head more closely, and the engine can be formed more compact.

According to a sixth aspect of the present invention, in addition any one of the second aspect to the fifth aspect, the case stores the first gear and the second gear, and at least a part of the case is positioned on the cylinder block side of an imaginary plane that includes a mating surface of the cylinder head and the cylinder block.

With the sixth aspect, since the case that stores the drive member of the valve shaft, the first gear, and the second gear is disposed in a dead space around the cylinder head, the space around the cylinder head can be utilized efficiently.

The above and other objects, characteristics and advantages of the present invention will be clear from detailed descriptions of the preferred embodiment which will be provided below while referring to the attached drawings.

DESCRIPTION OF THE PREFERRED EMBODIMENT

Hereinafter, an embodiment of the present invention will be explained referring to the attached drawings. Here, directions of up, down, front, rear, left, and right of the vehicle body are to be defined based on the visual line of a rider riding the two-wheeled motor vehicle.

Figure 1:
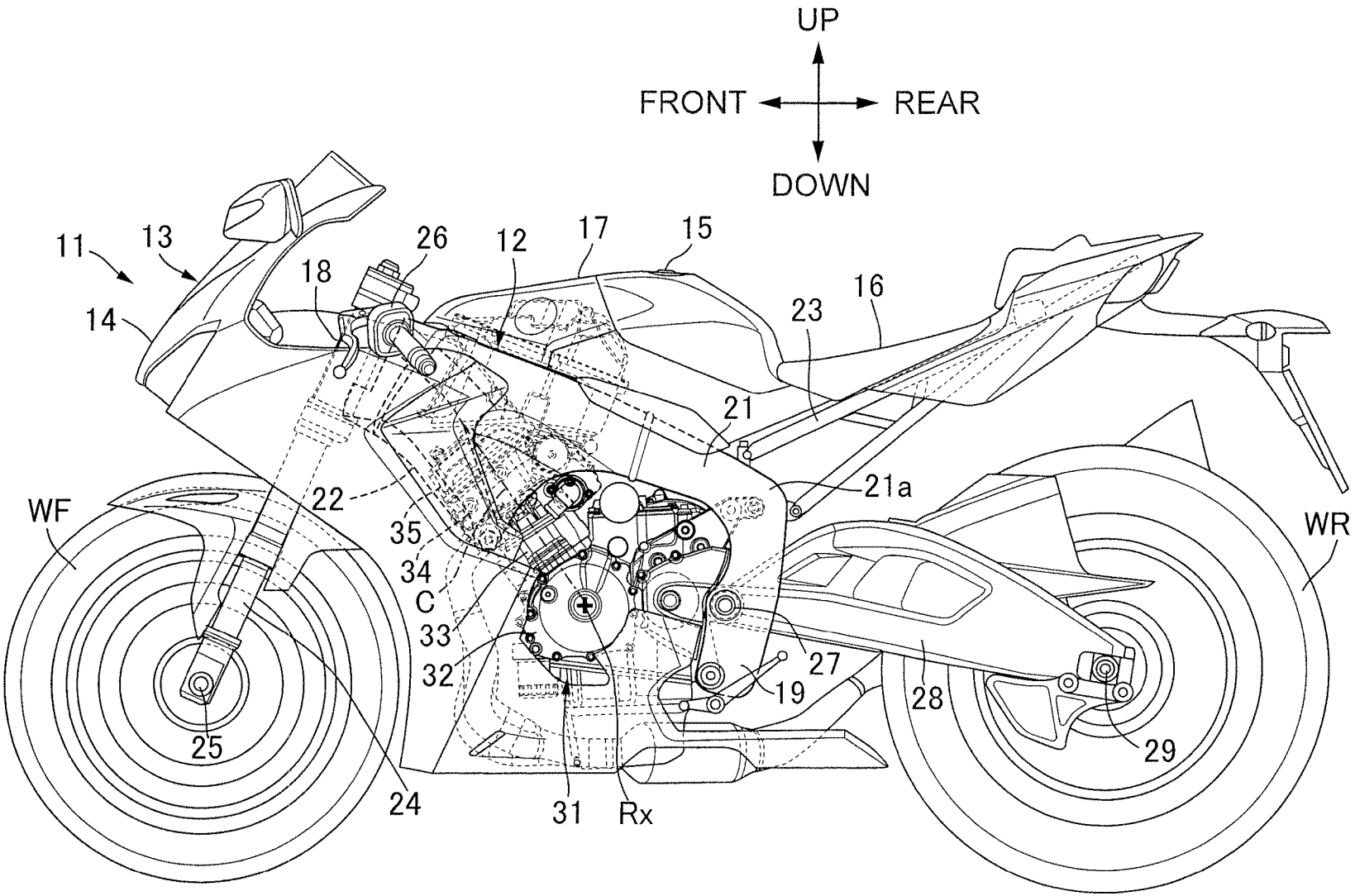
FIG. 1 is a side view that schematically shows an overall configuration of a two-wheeled motor vehicle according to an embodiment.

FIG. 1 schematically shows an overall image of a two-wheeled motor vehicle 11 that is a saddle riding vehicle according to an embodiment of the present invention. The two-wheeled motor vehicle 11 includes a body frame 12 and a body cover 13 that is mounted on the body frame 12. The body cover 13 includes a front cowl 14 and a tank cover 17, the front cowl 14 covering the body frame 12 from the front, the tank cover 17 continuing to the front from the outer surface of a fuel tank 15 and being connected to a riding seat 16 behind the fuel tank 15. The fuel is stored in the fuel tank 15. In driving the two-wheeled motor vehicle 11, the rider straddles the riding seat 16.

The body frame 12 includes a head pipe 18, a pair of left and right main frames 21, a down frame 22, and left and right seat frames 23, the main frames 21 extending downward to the rear from the head pipe 18 and including a pivot frame 19 at the rear lower end, the down frame 22 extending downward from the head pipe 18 at a position below the main frames 21 and being integrated with the main frames 21, the seat frames 23 extending upward to the rear from a curved region 21*a* of the main frame 21 and configuring a truss structure. The riding seat 16 is supported by the seat frames 23.

A front fork 24 is steerably supported by the head pipe 18. A front wheel WF is supported by the front fork 24 so as to be rotatable around an axle 25. A steering handlebar 26 is joined to the upper end of the front fork 24. The rider holds grips at the left and right ends of the steering handlebar 26 in driving the two-wheeled motor vehicle 11.

A swing arm 28 is connected to the body frame 12 at a rear part of the vehicle so as to be capable of swinging in the up-down direction around a pivot 27. A rear wheel WR is supported by the rear end of the swing arm 28 so as to be rotatable around an axle 29. An engine 31 is mounted on the body frame 12 between the front wheel WF and the rear wheel WR, the engine 31 generating power that is transmitted to the rear wheel WR. The engine 31 is connected to and supported by the down frame 22 and the main frames 21. The power of the engine 31 is transmitted to the rear wheel WR through a transmission device.

Figure 2:
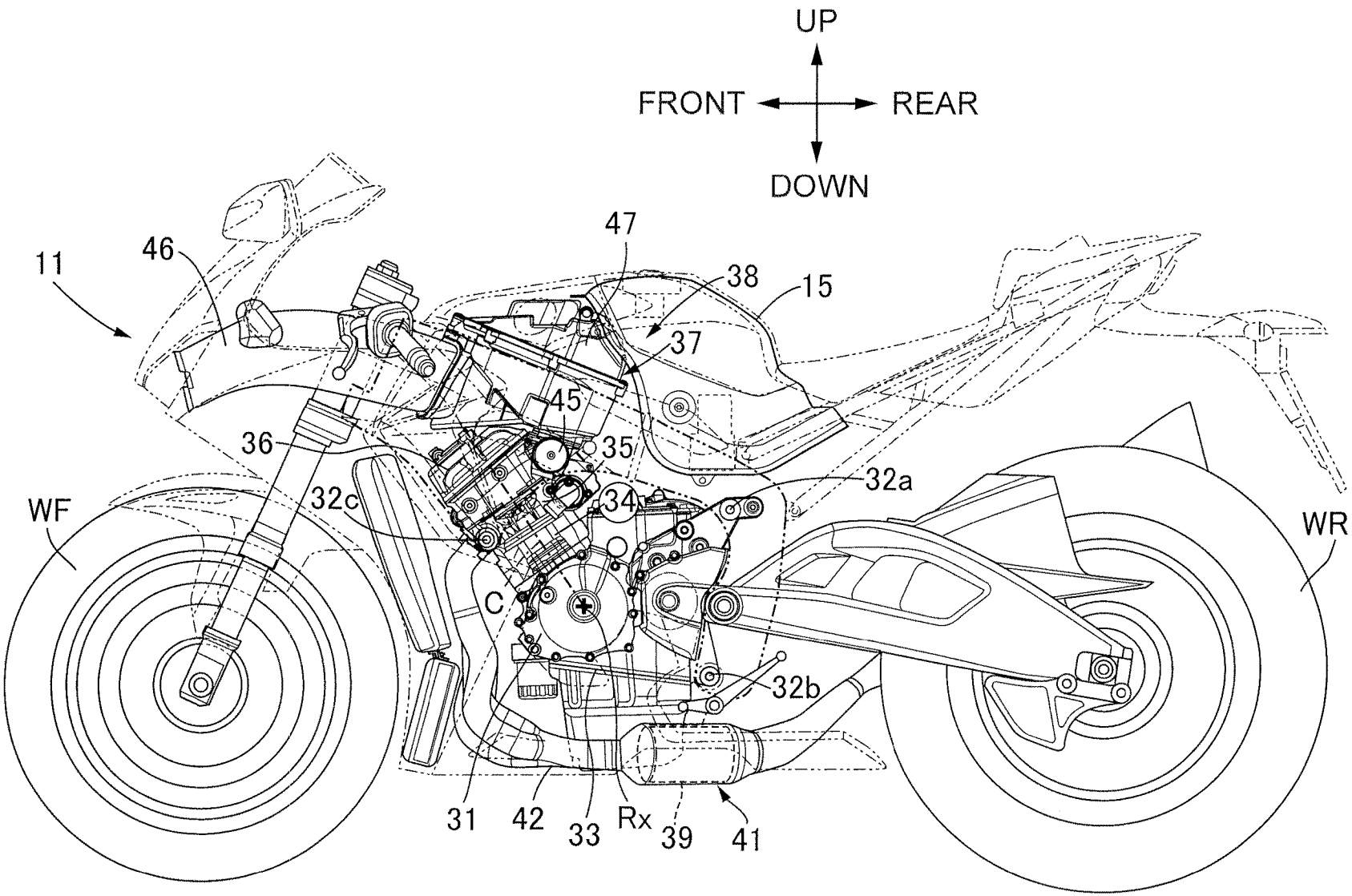
FIG. 2 is a side view that schematically shows an overall configuration of the two-wheeled motor vehicle in a state where a body cover is detached.

As shown in FIG. 2, the engine body of the engine 31 includes a crankcase 33, a cylinder block 34, a cylinder head 35, and a head cover 36, the crankcase 33 including engine hangers 32*a*, 32*b* at the upper end and the lower end of the rear wall and outputting power around a rotation axis Rx, the engine hangers 32*a*, 32*b* being connected to the main frames 21, the cylinder block 34 being joined to the front portion of the crankcase 33 from above and having a cylinder axis C that is positioned within a vertical plane orthogonal to the rotation axis Rx and stands up with respect to a horizontal plane, the cylinder head 35 being joined to the upper end of the cylinder block 34, including an engine hanger 32*c* in the front wall, and supporting a valve train, the engine hanger 32*c* being connected to the down frame 22, the head cover 36 being joined to the upper end of the cylinder head 35 and covering the valve train on the cylinder head 35. Here, in the cylinder block 34, four cylinders are disposed in series in the vehicle width direction determined by the rotation axis Rx that is parallel to the axle 29.

To the cylinder head 35, an intake device 38 and an exhaust device 41 are connected, the intake device 38 spraying fuel to the air that is purified by an air cleaner 37, generating an air-fuel mixture, and supplying the air-fuel mixture to the combustion chamber that is covered by the cylinder head 35, the exhaust device 41 purifying exhaust gas after combustion by a catalyst 39 and discharging the exhaust gas to the rear of the vehicle body while lowering the temperature of the exhaust gas, the exhaust gas being discharged from the combustion chamber. The exhaust device 41 includes an exhaust pipe 42 that passes under the crankcase 33, extends along a lateral side of the rear wheel WR, and supports the catalyst 39 below the crankcase 33.

The air cleaner 37 includes an air cleaner box 47 that is joined to a throttle body 45 and takes in travelling air from an air duct 46 that opens in front of the head pipe 18. The air cleaner 37 takes in the travelling air into the air cleaner box 47 for purification, and delivers the purified air to the engine 31. The air cleaner box 47 is covered by the fuel tank 15 from the rear.

Figure 3:
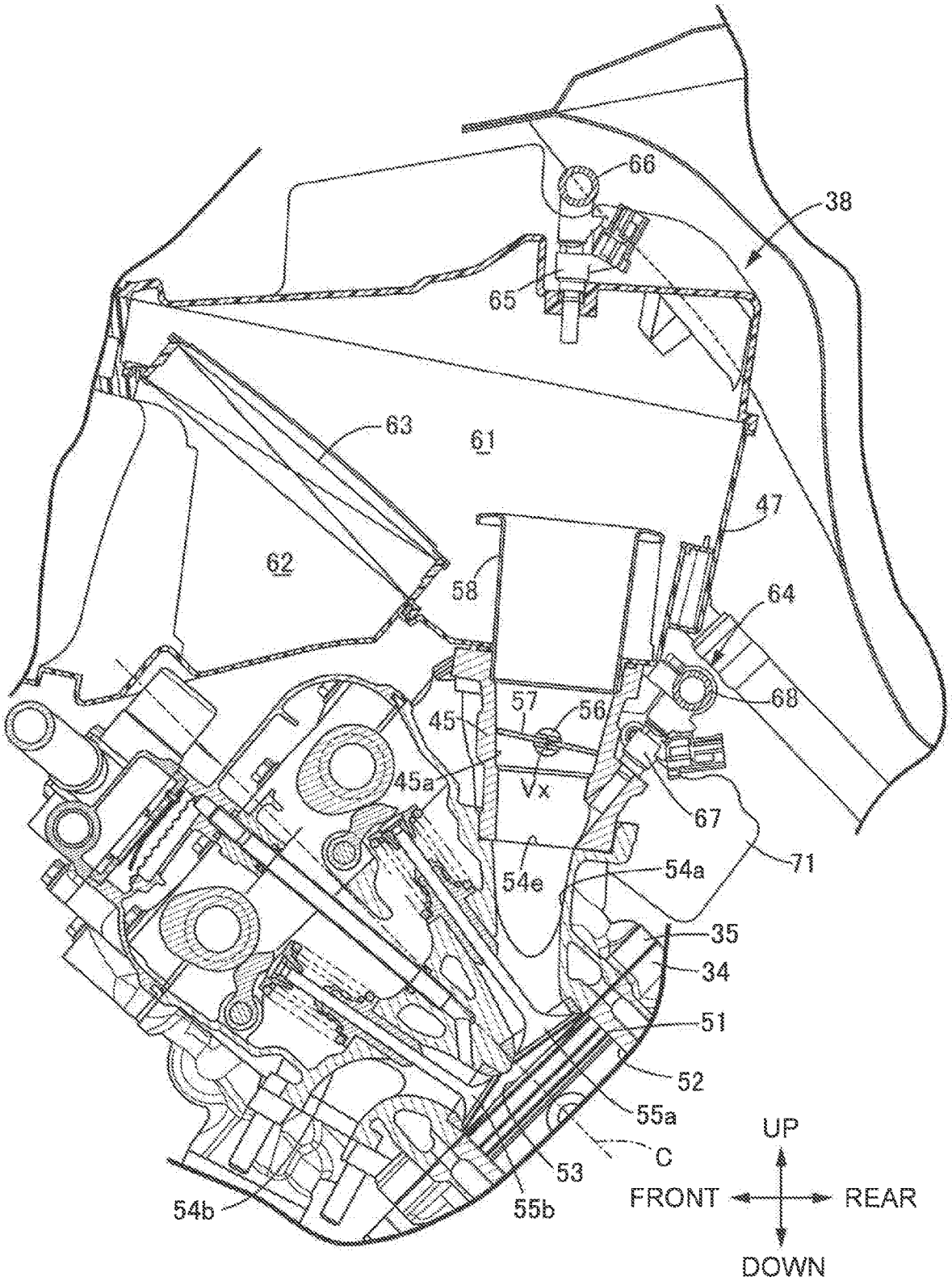
FIG. 3 is a view that schematically shows a configuration of an engine and an air cleaner box observed in a vertical section orthogonal to the rotation axis of the engine.

As shown in FIG. 3, a cylinder 52 is defined in the cylinder block 34, the cylinder 52 guiding a linear reciprocating motion of a piston 51 along the cylinder axis C. A combustion chamber 53 is formed between the piston 51 and the cylinder head 35. To the combustion chamber 53, a pair of intake ports 54*a* (only one is illustrated) and a pair of exhaust ports 54*b* (only one is illustrated) are connected, the pair of intake ports 54*a* and the pair of exhaust ports 54*b* opening at the ceiling of the combustion chamber 53. By the cylinder head 35, intake valves 55*a* and exhaust valves 55*b* are supported so as to be displaced in the axial direction, the intake valves 55*a* opening/closing an opening of each of the intake ports 54*a*, the exhaust valves 55*b* opening/closing an opening of each of the exhaust ports 54*b*.

The throttle body 45 is joined to the cylinder head 35. By the throttle body 45, a valve shaft 56 is supported so as to be rotatable around a rotation axis Vx. A throttle valve 57 is fixed to the valve shaft 56. The throttle valve 57 adjusts the degree of opening of an intake passage 45*a* inside the throttle body 45 according to the rotation around the rotation axis Vx. Each of the intake passages 45*a* is connected to two pieces of the intake ports 54*a* for each of the cylinders 52.

To the throttle body 45, a funnel 58 is joined for each of the cylinders 52. The funnel 58 penetrates the bottom wall of the air cleaner box 47 that is laid over the throttle body 45, and protrudes to a clean chamber 61 inside the air cleaner box 47. The space inside the air cleaner box 47 is divided into a dirty chamber 62 on the front side and the clean chamber 61 on the rear side by an air cleaner element 63, the dirty chamber 62 being connected to the air duct 46 and introducing the travelling air from the air duct 46. The air inside the dirty chamber 62 is filtered by the air cleaner element 63, and flows in to the clean chamber 61. The purified air flows in from the funnel 58 to the intake ports 54*a* of the cylinder head 35 through the intake passage 45*a* inside the throttle body 45.

The intake device 38 includes a fuel supply device 64 that sprays fuel to the air purified by the air cleaner 37. The fuel supply device 64 includes an upper injector 65, a first fuel supply pipe 66, a main injector 67, and a second fuel supply pipe 68, the upper injector 65 being incorporated into the upper wall of the air cleaner box 47 for each of the cylinders 52, the first fuel supply pipe 66 extending linearly in the vehicle width direction above the air cleaner box 47 and supplying the fuel to each of the upper injectors 65 from a branch pipe corresponding to each of the upper injectors 65, the main injector 67 being incorporated into the throttle body 45 for each of the cylinders 52, the second fuel supply pipe 68 extending linearly in the vehicle width direction behind the throttle body 45 and supplying the fuel to each of the main injectors 67 from a branch pipe corresponding to each of the main injectors 67.

Each of the upper injectors 65 injects the fuel downward toward the funnel 58. In a low rotation range of the engine 31, the fuel is injected from the main injector 67 in the intake passage 45*a* inside the throttle body 45. In a high rotation range of the engine 31, the fuel is injected from the upper injector 65 inside the clean chamber 61, and the mixing ratio is adjusted by the fuel injected from the main injector 67.

Figure 4:
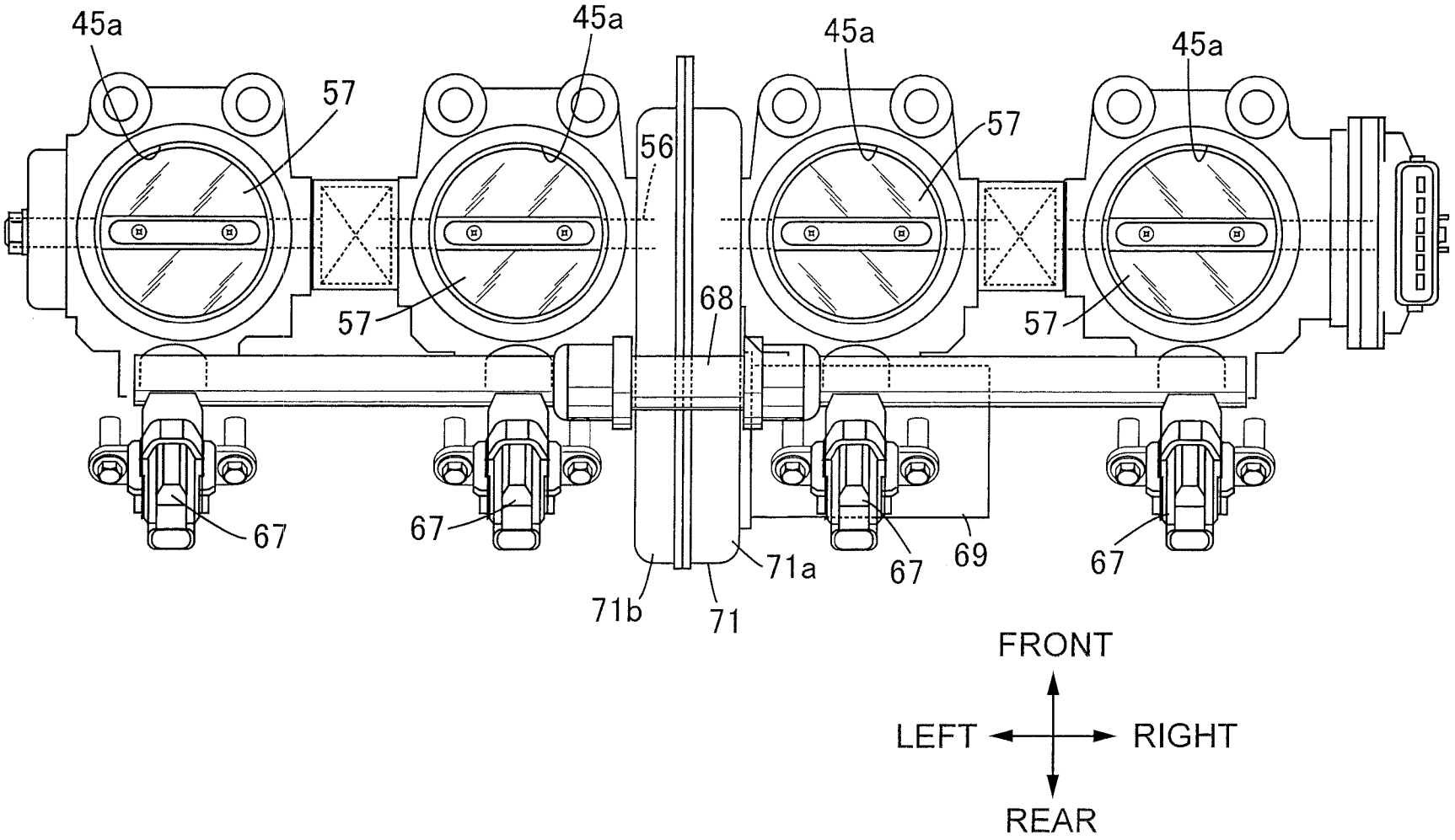
FIG. 4 is an enlarged top view of a throttle body.

As shown in FIG. 4, in a space between the two center intake passages 45*a*, a case 71 is disposed, the case 71 supporting a drive motor 69 below the second fuel supply pipe 68, the drive motor 69 generating drive power that is transmitted to the valve shaft 56. The case 71 includes a first body 71*a* and a second body 71*b*, the first body 71*a* being formed integrally with the throttle body 45 and being joined to the casing of the drive motor 69, the second body 71*b* being fastened to the first body 71*a* through a mating surface by fastening members, the mating surface being orthogonal to the rotation axis Vx of the valve shaft 56. The fastening members may be bolts screwed into female screw holes that are bored in a boss of the first body 71*a* for example. A storage space is defined in the inside of both of the first body 71*a* and the second body 71*b*.

Figure 5:
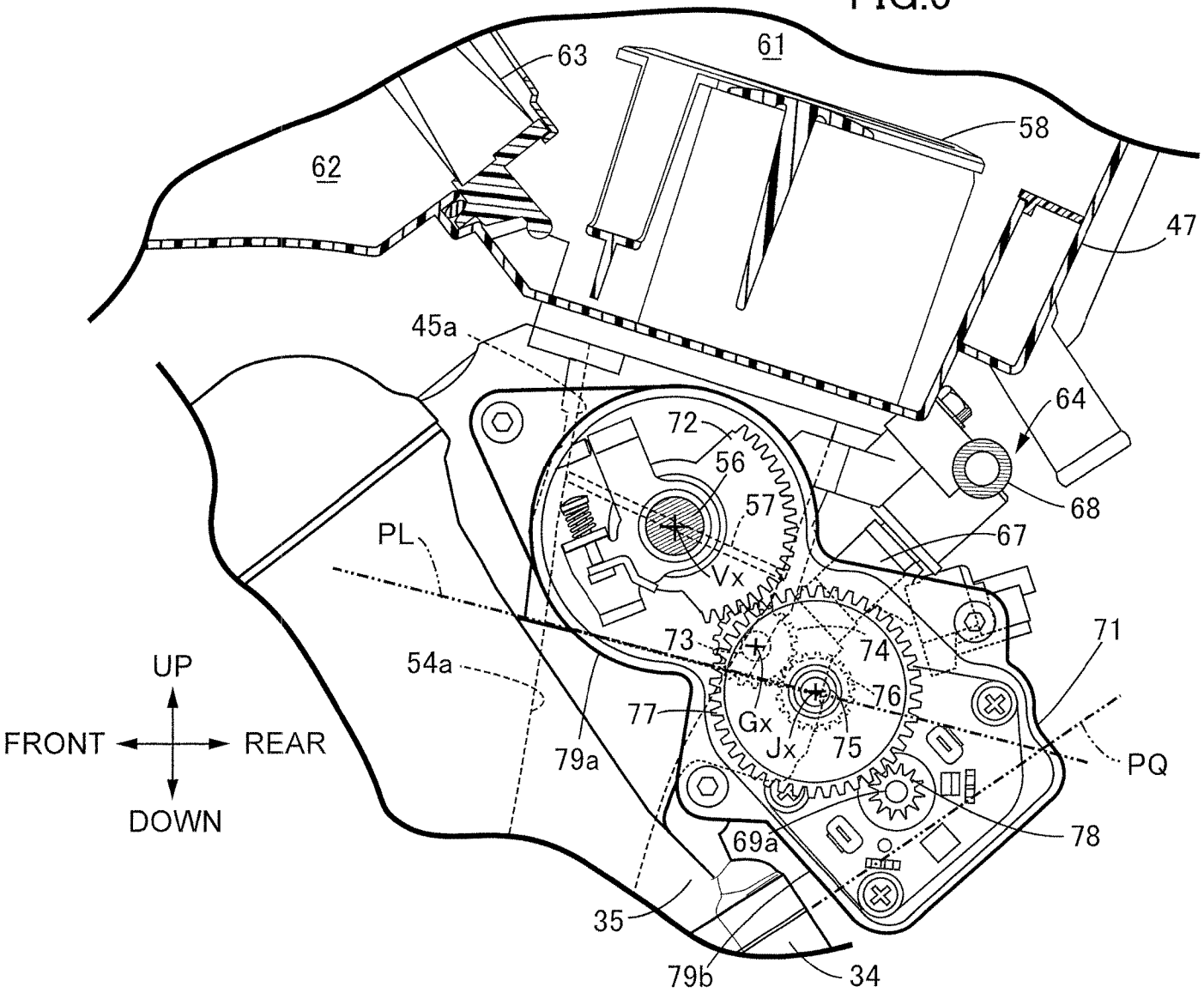
FIG. 5 is an enlarged side view that schematically shows a configuration of a deceleration mechanism interposed between the valve shaft of a throttle valve and a drive motor.

As shown in FIG. 5, in the case 71, a sector gear (drive member) 72, a first gear 74, a second gear 76, a third gear 77, and a drive gear 78 are stored, the sector gear 72 being fixed to the valve shaft 56, the first gear 74 being attached to a first shaft 73 and engaging with the sector gear 72, the first shaft 73 having an axis Gx that is parallel to the rotation axis Vx of the valve shaft 56, the second gear 76 being attached to a second shaft 75 and engaging with the first gear 74, the second shaft 75 having an axis Jx that is parallel to the rotation axis Vx of the valve shaft 56, the third gear 77 being integrated with the second gear 76 so as to be coaxial with the second gear 76 and having a larger diameter compared to the second gear 76, the drive gear 78 being fixed to a drive shaft 69*a* of the drive motor 69 and engaging with the third gear 77. When the drive shaft 69*a* of the drive motor 69 rotates, the rotational force of the drive shaft 69*a* is transmitted from the drive gear 78 to the third gear 77. Since the third gear 77 is integrated with the second gear 76, the rotational force of the third gear 77 causes rotation of the second gear 76 around the axis Jx of the second shaft 75. The second gear 76 rotates around the axis Jx of the second shaft 75, and transmits a drive force to the first gear 74. Thus, the drive force is transmitted from the drive motor 69 to the first gear 74. The first gear 74 rotates around the axis Gx of the first shaft 73, rotates the sector gear 72, and drives the valve shaft 56. The case 71 defines a space having a circular plate shape extending to the outside of the sector gear 72 so as to be coaxial with the rotation axis of the sector gear 72.

The case 71 includes a first outer wall 79*a* and a second outer wall 79*b*, the first outer wall 79*a* having a cylindrical shape surrounding the moving route of the sector gear 72 that rotates around the rotation axis Vx, the second outer wall 79*b* continuing from the first outer wall 79*a* and having a squarish shape that surrounds the third gear 77. The second outer wall 79*b* is disposed along the cylinder block 34 and the cylinder head 35. The first gear 74 protrudes from a space surrounded by the second outer wall 79*b* toward a space surrounded by the first outer wall 79*a*, and engages with the sector gear 72. The first outer wall 79*a* is narrowed toward the second outer wall 79*b* while leaving the occupying spaces of the first gear 74 and the third gear 77. The cylindrical shape of the first outer wall 79*a* is cut at the occupying space of the first gear 74.

Here, the first outer wall 79*a* overlaps with the intake port 54*a* at least partially as seen in a side view of the vehicle body. In other words, the first outer wall 79*a* is positioned on the cylinder head side of an imaginary plane PL that includes the outer end of the intake port 54*a*. Preferably, the drive shaft 69*a* of the drive motor 69 is positioned on the cylinder head side of the imaginary plane PL that includes the outer end of the intake port 54*a*. In addition, the second gear 76 is positioned on the cylinder head side of the imaginary plane PL at least partially, the imaginary plane PL including the outer end of the intake port 54*a*. To the extent possible, the first gear 74 is positioned on the cylinder head side of the imaginary plane PL at least partially, the imaginary plane PL including the outer end of the intake port 54*a*. The second outer wall 79*b* is positioned on the cylinder block 34 side of an imaginary plane PQ that includes the mating surface of the cylinder head 35 and the cylinder block 34.

Next, the operation of an internal combustion engine according to the present embodiment will be explained. When an accelerator is operated, the throttle valve 57 rotates according to the operation amount. The degree of opening of the intake passage 45*a* (intake path) is set according to the rotation of the throttle valve 57. The air inside the clean chamber 61 flows in from the funnel 58 to the intake passage 45*a* and the intake port 54*a*. The air-fuel mixture flows in to the combustion chamber 53 in response to an opening/closing operation of the intake valve 55*a*. Linear reciprocating motion of the piston 51 is achieved in response to combustion of the air-fuel mixture inside the combustion chamber 53.

When the throttle valve 57 rotates, the operation amount of the accelerator is detected. A detection signal determining the operation amount is fed to an ECU (electronic control unit). The ECU determines the rotation amount of the throttle valve 57 according to a predetermined correspondence relation. A control signal determining the rotation amount is fed to the drive motor 69. The drive motor 69 rotates the drive shaft 69*a* by the rotation amount designated by the control signal. Rotation of the drive shaft 69*a* is transmitted from the drive gear 78 to the third gear 77. Rotation of the third gear 77 causes rotation of the second gear 76 around the axis Jx of the second shaft 75. The second gear 76 rotates around the axis Jx of the second shaft 75, and transmits a drive force to the first gear 74. Thus, the drive force is transmitted from the drive motor 69 to the first gear 74. The first gear 74 rotates around the axis Gx of the first shaft 73, rotates the sector gear 72, and drives the valve shaft 56.

In the engine 31 according to the present embodiment, when the throttle valve 57 is operated, the sector gear 72 is displaced around the rotation axis Vx of the valve shaft 56. The case 71 has an extent that does not interfere with the sector gear 72 when the sector gear 72 is displaced. Meanwhile, the case 71 overlaps with the intake port 54*a* as seen in the side view. In other words, the outer wall of the case 71 surrounding the moving route of the sector gear 72 is positioned on the cylinder head 35 side of the imaginary plane PL that includes the outer end of the intake port 54*a*. Therefore, the throttle valve 57 can approach the intake port 54*a* as much as possible. Thus, the volume of the intake passage can be reduced from the downstream of the throttle valve 57 to the combustion chamber 53. As a result, the intake efficiency improves.

In the present embodiment, the engine 31 includes the first gear 74 and the second gear 76, the first gear 74 being attached to the first shaft 73, engaging with the sector gear 72, rotating around the axis Gx of the first shaft 73, and driving the valve shaft 56, the second gear 76 being attached to the second shaft 75, engaging with the first gear 74 and the drive gear 78 (through the third gear 77 that is integrated with the second gear 76), rotating around the axis Jx of the second shaft 75, and transmitting the drive force from the drive motor 69 to the first gear 74. The first gear 74 of the first shaft 73 and the second gear 76 (and the third gear) of the second shaft 75 configure a deceleration mechanism between the sector gear 72 and the drive motor 69. Since the deceleration mechanism is disposed between the sector gear 72 and the drive motor 69, the drive motor 69 gets away from the intake port 54*a*. As a result, interference of the drive motor 69 and the intake port 54*a* can be avoided.

At this time, the drive shaft 69*a* of the drive motor 69 is positioned on the cylinder head 35 side of the imaginary plane PL that includes the outer end of the intake port 54*a*. Therefore, since the drive motor 69 is disposed at a position close to the cylinder head 35, the engine 31 can be formed compact. Also, since the drive motor 69 is disposed in a dead space around the cylinder head 35, a space around the cylinder head 35 can be utilized efficiently.

In addition, the second gear 76 is positioned on the cylinder head 35 side of the imaginary plane PL at least partially, the imaginary plane PL including the outer end of the intake port 54*a*. Since the second gear 76 of the deceleration mechanism is disposed at a position close to the cylinder head 35, the drive motor 69 can get access to the cylinder head 35 more closely, and the engine 31 can be formed more compact.

Also, the first gear 74 is positioned on the cylinder head 35 side of the imaginary plane PL at least partially, the imaginary plane PL including the outer end of the intake port 54*a*. Since the first gear 74 of the deceleration mechanism is disposed at a position close to the cylinder head 35, the drive motor 69 can get access to the cylinder head 35 more closely, and the engine 31 can be formed more compact.

In the engine 31 according to the present embodiment, at least a part of the case 71 is positioned on the cylinder block 34 side of the imaginary plane PQ that includes the mating surface of the cylinder head 35 and the cylinder block 34. Since the case 71 that stores the sector gear 72, the first gear 74, and the second gear 76 is disposed in a dead space around the cylinder head 35, a space around the cylinder head 35 can be utilized efficiently.

What is claimed is:

1. An engine, comprising:

a cylinder head that forms an intake port connected to a combustion chamber;

a throttle body that is joined to the intake port and adjusts a degree of an opening of an intake passage by rotating a throttle vale around a rotation axis of a valve shaft, the throttle vale being fixed to the valve shaft; and a case that stores a drive member and supports a drive motor, the drive member being fixed to the valve shaft, the drive motor generating a drive force that is transmitted to the drive member, wherein the case overlaps with the intake port as seen in a side view, and wherein the engine further comprises:

a first gear that is attached to a first shaft, engages with the drive member, rotates around an axis of the first shaft, and drives the valve shaft; and a second gear that is attached to a second shaft, engages with the first gear, rotates around an axis of the second shaft, and transmits a drive force from the drive motor to the first gear, wherein a drive shaft of the drive motor is entirely positioned on a cylinder head side of an imaginary plane that comprises mating surfaces of the cylinder head and a cylinder block, the imaginary plane intersects with a plane including the outer end of the intake port; and, wherein a longitudinal axis of the drive shaft is parallel to the imaginary plane and the plane including the outer end of the intake port.

2. The engine according to claim 1, wherein the second gear is positioned at least partially on the cylinder head side of the plane including the outer end of the intake port.

3. The engine according to claim 2, wherein the first gear is positioned at least partially on the cylinder head side of the plane including the outer end of the intake port.

4. The engine according to claim 3, wherein the case stores the first gear and the second gear, and wherein at least a part of the case is positioned on the cylinder block side of the imaginary plane that includes a mating surface of the cylinder head and the cylinder block.

5. The engine according to claim 2, wherein the case stores the first gear and the second gear, and wherein at least a part of the case is positioned on the cylinder block side of the imaginary plane that includes the mating surface of the cylinder head and the cylinder block.

6. The engine according to claim 1, wherein the case stores the first gear and the second gear, and wherein at least a part of the case is positioned on the cylinder block side of the imaginary plane that includes the mating surface of the cylinder head and the cylinder block.

7. The engine according to claim 1, wherein the intake port is arranged to extend at an inclination to a cylinder axis of a cylinder block and the plane including the outer end of the intake port is inclined relative to the cylinder axis.

8. An engine, comprising:

a cylinder head that forms an intake port connected to a combustion chamber;

a throttle body that is joined to the intake port and adjusts a degree of an opening of an intake passage by rotating a throttle vale around a rotation axis of a valve shaft, the throttle vale being fixed to the valve shaft; and a case that stores a drive member and supports a drive motor, the drive member being fixed to the valve shaft, the drive motor generating a drive force that is transmitted to the drive member, wherein the case overlaps with the intake port as seen in a side view, wherein a drive shaft of the drive motor is entirely positioned on a cylinder head side of an imaginary plane that comprises mating surfaces of the cylinder head and a cylinder block, the imaginary plane intersects with a plane including the outer end of the intake port; and, wherein a longitudinal axis of the drive shaft is parallel to the imaginary plane and the plane including the outer end of the intake port.

9. The engine according to claim 8, wherein the engine further comprises: a first gear that is attached to a first shaft, engages with the drive member, rotates around an axis of the first shaft, and drives the valve shaft; and a second gear that is attached to a second shaft, engages with the first gear, rotates around an axis of the second shaft, and transmits a drive force from the drive motor to the first gear.

10. The engine according to claim 9, wherein the second gear is positioned at least partially on the cylinder head side of the plane including the outer end of the intake port.

11. The engine according to claim 10, wherein the first gear is positioned at least partially on the cylinder head side of the plane including the outer end of the intake port.

12. The engine according to claim 11, wherein the case stores the first gear and the second gear, and wherein at least a part of the case is positioned on the cylinder block side of the imaginary plane that includes the mating surface of the cylinder head and the cylinder block.

13. The engine according to claim 10, wherein the case stores the first gear and the second gear, and wherein at least a part of the case is positioned on the cylinder block side of the imaginary plane that includes the mating surface of the cylinder head and the cylinder block.

14. The engine according to claim 9, wherein the case stores the first gear and the second gear, and wherein at least a part of the case is positioned on the cylinder block side of the imaginary plane that includes the mating surface of the cylinder head and the cylinder block.

15. The engine according to claim 8, wherein the intake port is arranged to extend at an inclination to a cylinder axis of a cylinder block and the plane including the outer end of the intake port is inclined relative to the cylinder axis.

* * * * *